US012503291B2

(12) United States Patent
Jacob

(10) Patent No.: US 12,503,291 B2
(45) **Date of Patent: *Dec. 23, 2025**

(54) NO SPILL STRAW

(71) Applicant: Brumate, Inc., Denver, CO (US)

(72) Inventor: Dylan M. Jacob, Denver, CO (US)

(73) Assignee: Brumate, Inc., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/079,102

(22) Filed: Mar. 13, 2025

(65) Prior Publication Data

US 2025/0206511 A1 Jun. 26, 2025

Related U.S. Application Data

(63) Continuation of application No. 18/516,771, filed on Nov. 21, 2023.

(60) Provisional application No. 63/529,988, filed on Jul. 31, 2023, provisional application No. 63/529,125, filed on Jul. 26, 2023.

(51) Int. Cl.
*B65D 77/28* (2006.01)

(52) U.S. Cl.
CPC ..... *B65D 77/286* (2013.01); *B65D 2231/022* (2013.01); *B65D 2543/00509* (2013.01)

(58) Field of Classification Search
CPC ..... B65D 77/286; B65D 2231/022; B65D 2543/00509; A47G 19/2222; A47G 21/18; A47G 19/22; A47G 19/2255
USPC ..... 215/389
See application file for complete search history.

(56) References Cited

U.S. PATENT DOCUMENTS

| | | | | |
|---|---|---|---|---|
| 7,950,541 | B2 | 5/2011 | Holcomb et al. | |
| 8,636,166 | B2 * | 1/2014 | Lane | B65D 47/242 222/549 |
| 11,213,146 | B1 * | 1/2022 | Sletten | B65D 47/261 |
| 2011/0132907 | A1 * | 6/2011 | Hajichristou | B65D 43/0225 215/337 |
| 2013/0214012 | A1 * | 8/2013 | Pils | B65D 47/247 222/524 |
| 2016/0200486 | A1 * | 7/2016 | Meyers | A47G 19/2288 215/229 |
| 2017/0341828 | A1 | 11/2017 | Balkus | |
| 2018/0050844 | A1 * | 2/2018 | Hirst | B65D 47/24 |

FOREIGN PATENT DOCUMENTS

| | | |
|---|---|---|
| CN | 203997451 U | 12/2014 |
| CN | 216187519 U | 4/2022 |
| CN | 218528398 U | 2/2023 |

(Continued)

OTHER PUBLICATIONS

Non-Final Office Action received for U.S. Appl. No. 18/516,771, mailed on Mar. 19, 2025, 18 pages.

(Continued)

*Primary Examiner* — Don M Anderson
*Assistant Examiner* — Eric C Baldrighi
(74) *Attorney, Agent, or Firm* — Shook, Hardy & Bacon L.L.P.

(57) ABSTRACT

Aspects disclosed herein generally relate to beverage systems. Particularly, beverage systems comprising a straw mechanism that is removably secured to a lid structure. The beverage systems in accordance with aspects herein have features to prevent leakage.

20 Claims, 14 Drawing Sheets

(56) References Cited

FOREIGN PATENT DOCUMENTS

| | | | |
|---|---|---|---|
| CN | 116807214 | A | 9/2023 |
| CN | 116831427 | A | 10/2023 |
| CN | 219813757 | U | 10/2023 |
| CN | 220403714 | U | 1/2024 |
| FR | 2966132 | A3 | 4/2012 |
| IT | 201900019226 | A1 | 4/2021 |
| TW | 202108052 | A | 3/2021 |
| WO | 2022/101249 | A1 | 5/2022 |

OTHER PUBLICATIONS

Screen Captures from Amazon, "Polar Camel Tumbler Lid Replacement—Magnetic Lid", Available online at: <https://www.amazon.com/Polar-Camel-Tumbler-Lid Replacement/dp/B09B4R7SLC/?th=1>, Jun. 10, 2021, 1 page.
Non-Final Office Action received for U.S. Appl. No. 19/075,465, mailed on May 2, 2025, 14 pages.
Office action received for GB Patent Application No. 2410921.7, mailed on Apr. 4, 2025, 4 pages.
Final Office Action received for U.S. Appl. No. 19/075,465, mailed on Jun. 2, 2025, 16 pages.
Office Action received for Australian Patent Application No. 2024205031, mailed on May 28, 2025, 4 pages.
Office Action received for Australian Patent Application No. 2024205031, mailed on Aug. 6, 2025, 3 pages.

* cited by examiner

NO SPILL STRAW

CROSS-REFERENCE TO RELATED APPLICATIONS

This application is a continuation of U.S. Non-Provisional application Ser. No. 18/516,771, filed on Nov. 21, 2023 entitled "No Spill Straw" and claims the benefit of U.S. Provisional Application No. 63/529,125 entitled "No Spill Straw," filed on Jul. 26, 2023 and U.S. Provisional Application No. 63/529,988 entitled "No Spill Straw," filed on Jul. 31, 2023.

TECHNICAL FIELD

Aspects provided herein relate to portable beverage accessories, such as insulated travel cups, shaker cups, and the like.

BACKGROUND

Travel beverage accessories often include insulated cups and non-insulated cups, double wall cups, or any other suitable beverage container that includes a fitted lid to prevent accidental spills. The lids can be simple screw on lids, or press-on lids, and may not always be leak-proof. Lids that are supposedly leak-proof oftentimes include a mechanism that typically requires two hands to operate, and can thus be cumbersome to use.

SUMMARY

At a high level, a beverage container may include a lid structure coupled to a base structure to define an interior volume for holding and/or dispensing a beverage held within the beverage container. The base structure may be a cup shaped container that may optionally be insulating to keep drinks cold/hot for extended periods of time (e.g., between 4 hours and 48 hours). The lid structure may have a spout portion or a straw mechanism for dispensing the contents of the beverage container when the lid structure and the base structure are engaged with one another. In order to provide a leak-proof beverage container, the straw mechanism is able to rotatably transition between a closed state (i.e., a not dispensing state, a no-spill state, a traveling state, or a not in use) and an open state (i.e., a dispensing state). When in its closed state, the straw mechanism prevents the contents of the beverage container from spilling out or otherwise being dispensed or consumed from the beverage container. When in its open state, the straw mechanism allows the contents of the beverage container to be consumed or otherwise dispensed from the beverage container.

The lid structure in accordance with aspects herein comprises a straw mechanism and a body portion. The body portion has a threaded engagement section configured to securely engage the base structure of the beverage container, and an engagement cavity configured to receive and engage with the straw mechanism, as will become more apparent in the description with respect to the figures provided below. The straw mechanism and the body portion are disengageably engaged to each other to facilitate cleaning of the lid structure. Further, the straw mechanism and the body portion are rotatably engaged to provide a leak-proof lid structure for traveling or general portability. This is advantageous over conventional straw-based beverage containers, where the straw extends through a penetrable opening in the lid, or the straw itself is an open conduit to the contents of the container, both of which are potential areas of leakage.

Aspects herein are generally directed to a lid structure for a beverage container having a body portion including a straw connector that is configured to disengageably attach to a disengageable straw. Among other things, the disengageable straw facilitates the thorough cleaning of the lid structure, and also provides for a neatly storable container that can fit all of its parts within the interior volume defined by the base structure and the lid structure.

The straw mechanism of the lid structure comprises a spout portion having a spout opening and a frame portion. In an embodiment, the spout portion may be rigid and formed from a hard polymer, a plastic material, a metal, or other rigid material, by way of non-limiting example. In another embodiment, the spout portion may be flexible (i.e., bendable, stretchable, elastic, deformable) and formed from a suitable material such as silicone or other rubber polymer material, by way of non-limiting example. The frame portion frames the spout portion so that the spout portion extends outwardly through an opening of the frame portion and a first surface of the frame portion. Further, the first surface of the frame portion comprises a first indicator that protrudes from the first surface. A spout base portion is wider than the spout portion and sits on a second surface of the frame portion, sealing the opening of the frame portion. The spout opening of the spout portion extends through to the spout base portion. In some aspects the spout portion is shaped like a conventional straw having a cylindrical tubular structure having a circular cross-section with a circular opening. In other aspects, the spout portion may have a tubular structure having any desired cross-sectional shape with a correspondingly shaped opening such as triangular, star, square, etc., by way of non-limiting example. In other aspects, the opening may always be half shape regardless of the cross-sectional shape of the spout portion (e.g., half circle, half star, half triangle, half square, etc., by way of non-limiting example). However, in a preferred embodiment, the spout base portion may always have a half shape opening. In other words, if the spout has a circular shaped opening, the spout base portion may have a half circle shaped opening.

The second surface of the frame portion further comprises a first ring shaped magnet housing protruding from the second surface that houses a ring shaped magnet. Further, an outer surface of the ring shaped magnet housing forms a key with a first ridge and a second ridge, where each partially extend around a circumference of the magnet housing. The first ridge has a first length that is different from the second length of the second ridge. The edge of second surface of the frame portion further comprises a ridge aligning with the first indicator on the first surface of the frame portion and a notch located opposite the ridge.

The engagement cavity of the body portion of the lid structure is configured to engage with the straw mechanism by receiving the magnet housing so that the first surface of the frame portion of the straw mechanism is flush with an exterior surface of the lid structure when engaged to the lid structure. The body portion of the lid structure forms a second ring shaped magnet housing protruding from an inner surface of the body portion that houses a second ring shaped magnet having an opposite polarity to the first ring magnet, creating a strong attraction between the frame portion of the straw mechanism and the body portion of the lid structure. The engagement cavity comprises a first lip and a second lip, the first lip and the second lip form a key hole in the body portion so that the straw mechanism is always received by the body portion in a predetermined configuration. Further, the body portion comprises a couple of stop tabs to lock rotation of the straw mechanism along an 180° path. The second ring shaped magnet is contained within the second ring shaped magnet housing by a cover portion. The cover portion having a half-circle opening configured to align with the half circle opening of the spout base portion. Such that when the half-circle opening of the spout base portion and the half-circle opening of the cover portion are aligned, there is flow from the spout portion and when the half-circle opening and the cover portion and the half-circle opening of the spout portion are misaligned (i.e., on opposite sides), there is no flow from the spout portion.

Aspects herein are generally further directed to a beverage container, the beverage container being comprised of a base structure and a lid structure having a magnetic straw mechanism. The base structure may be comprised of a double wall plastic structure, glass, or polymer based material structure, or a thermally insulating structure comprised of stainless steel, aluminum, copper, or any other suitable material or combination of materials suitable for insulating the contents of the beverage container from external temperature fluctuations for extended periods of time. The base structure in accordance with aspects herein includes an outer wall and an inner wall. The inner wall of the base structure includes a threaded portion proximal to the opening edge of the base structure. A step edge is provided in the inner wall of the base structure that defines the end of the threaded portion and the start of a non-threaded portion of the inner wall, where the non-threaded portion of the inner wall extends inward toward a relative center of the container further than the internal threaded section of the base structure. The inner wall may optionally include volume markings configured to signal a volume quantity contained within the base structure as the base structure is filled with a beverage. The volume of the base structure may be sized and shaped to hold between 14 oz. and 100 oz. of a beverage.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

The subject matter of embodiments of the present invention is described with specificity herein to meet statutory requirements. However, the description itself is not intended to limit the scope of this patent. Rather, the inventor(s) have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Figure 1:
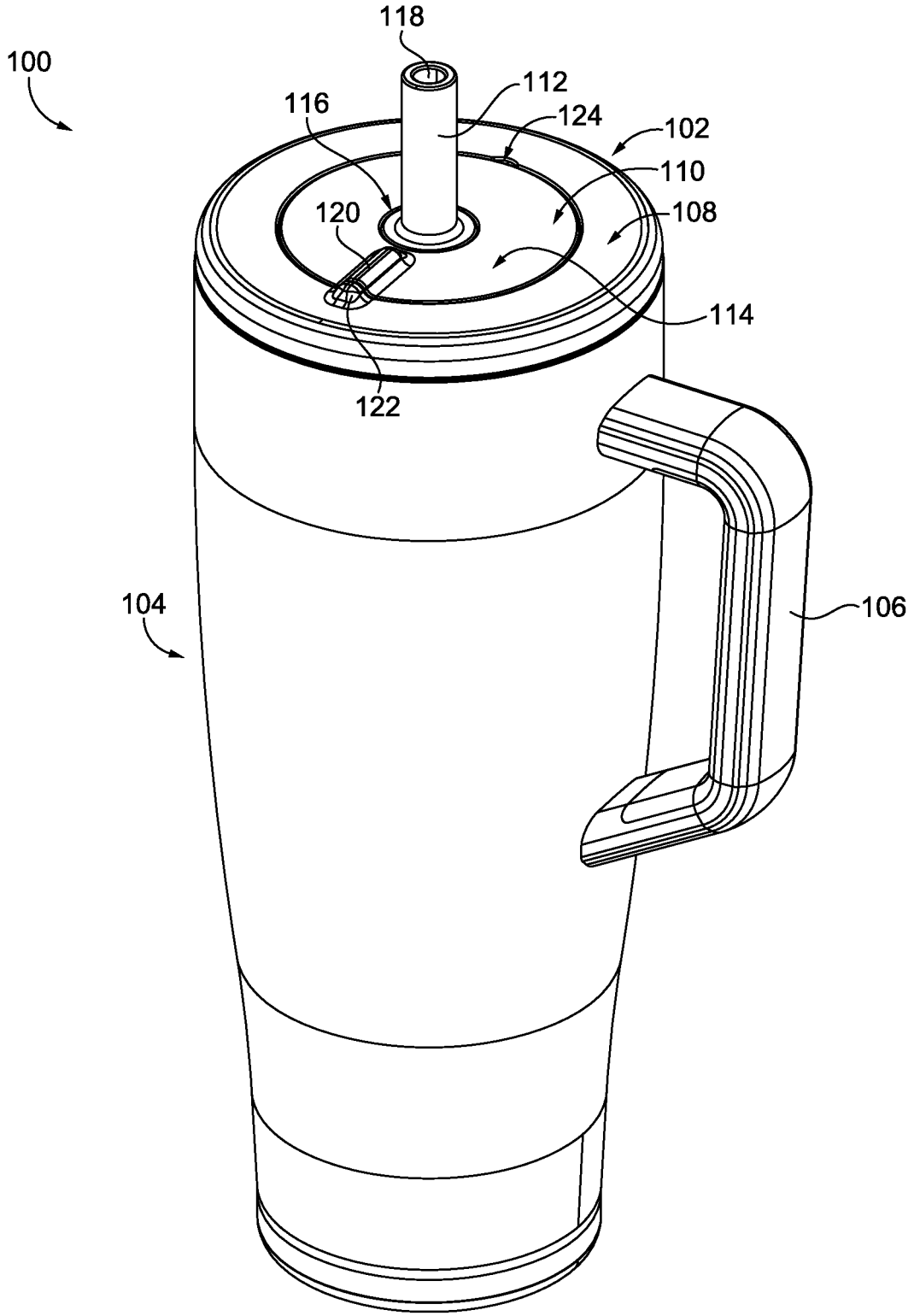
FIG. 1 depicts a perspective view of an assembled beverage system with a lid structure, in accordance with aspects herein.

At a high level, a beverage system 100 as shown in FIG. 1 is disclosed. The beverage system 100 comprises a lid structure 102 and a base structure 104 as the main components. The beverage system may optionally further include a handle 106 to facilitate carrying of the beverage system 100. As further shown in FIG. 1, the lid structure 102 can have a body portion 108, a straw mechanism 110 having a spout portion 112 with a spout opening 118 through which a user is able to drink fluids contained within the beverage system 100. The straw mechanism 110 further includes a frame portion 114. The spout portion 112 extends through an opening 116 of the frame portion 114 so that it extends through and above a first surface (exterior surface) of the frame portion 114. The frame portion can also comprise a first indicator 120 that guides the user to different positions or states of the straw mechanism 100, such as, a dispensing state (shown in FIGS. 9 and 10), a locked state or spill-proof state (shown in FIGS. 11 and 12, and a disassemble or cleaning state (shown in FIGS. 7 and 8).

Figure 2:
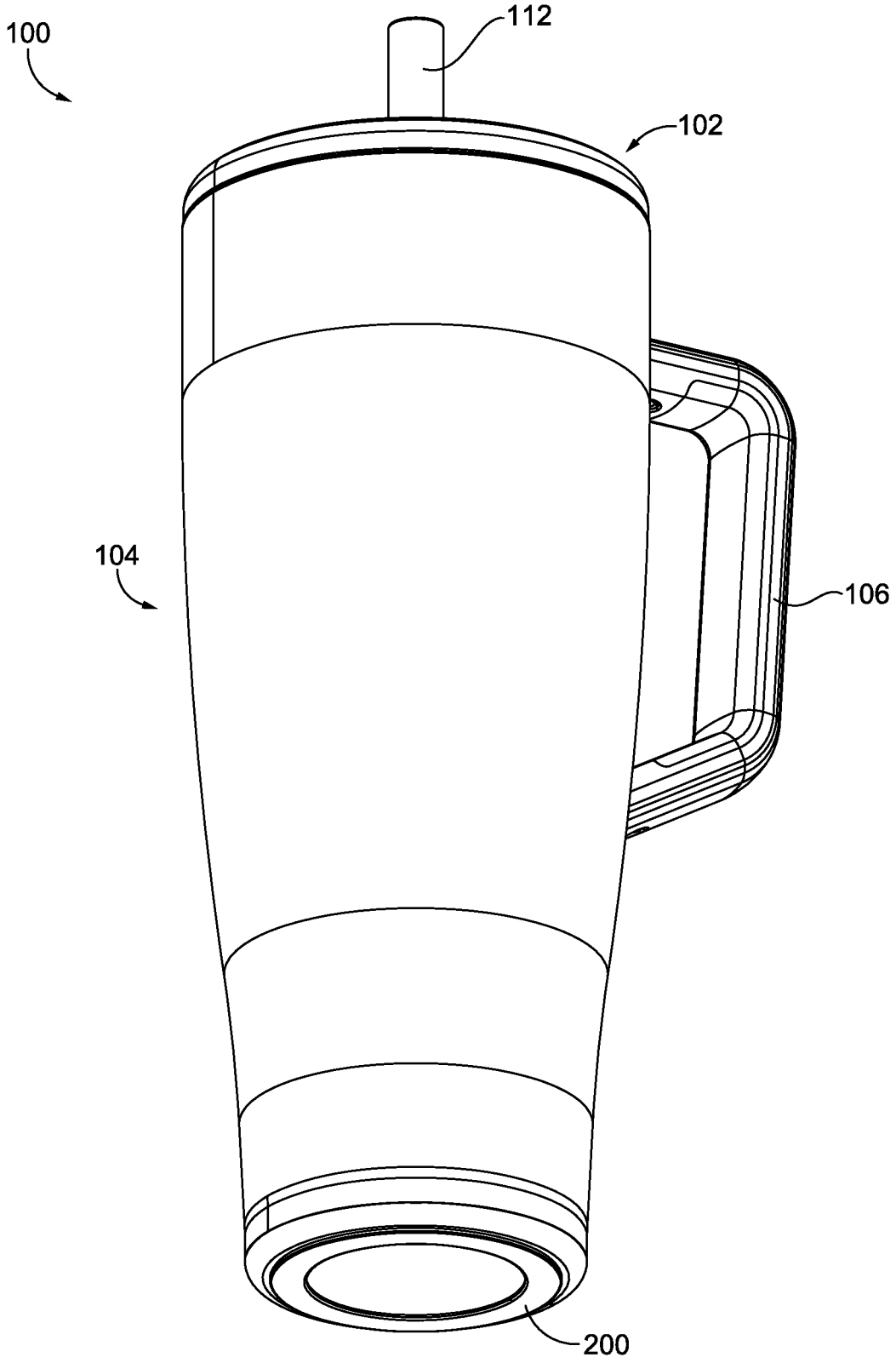
FIG. 2 depicts a different perspective view of the beverage system shown in FIG. 1 in a disassembled state, in accordance with aspects herein.

The body portion 108 of the lid structure 102 can comprise a second indicator 122 that is complementary to the first indicator 120, that when aligned with each other, indicate, for example, that the straw mechanism 110 is in its dispensing state. Further, the body portion 108 comprises a vent 124 for allowing proper air circulation within the beverage system 100 as the contents are pulled from the base structure 104 when the user is drinking from the spout portion 112, thereby, insuring a proper flow or maintenance of a proper flow of the liquid through the spout opening 118 of the spout portion 112. As shown, the base structure 104 of the beverage system 100 may optionally include a handle 106 to facilitate transport of the beverage system 100 by a user. Furthermore, as shown in FIG. 2, the beverage system 100 may further include an anti-slip pad 200 on the base or bottom of the base structure 104 to aid in keeping the beverage system 100 from sliding across a flat surface such as a counter, a table, and the like. Exemplary materials that can be used for the anti-slip pad 200 can include, for example, natural rubber, synthetic rubber, rubberized silicone, thermoplastic polyurethane, polyurethane, neoprene, nitrile, and any other suitable material having desirable properties for the anti-slip pad 200.

Figure 3:
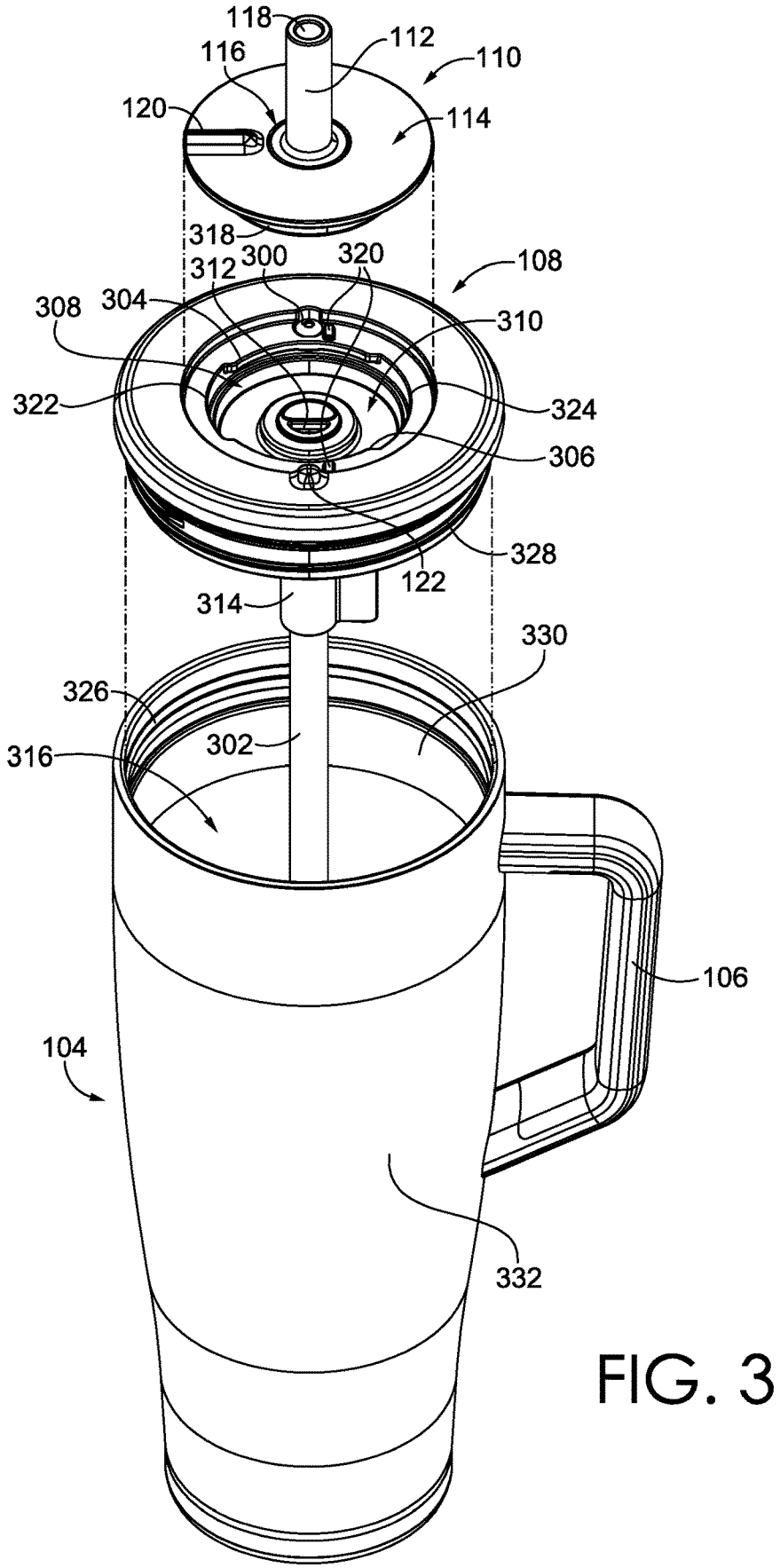
FIG. 3 depicts a perspective view of the beverage system in FIG. 1, in a disassembled state.
Figure 4:
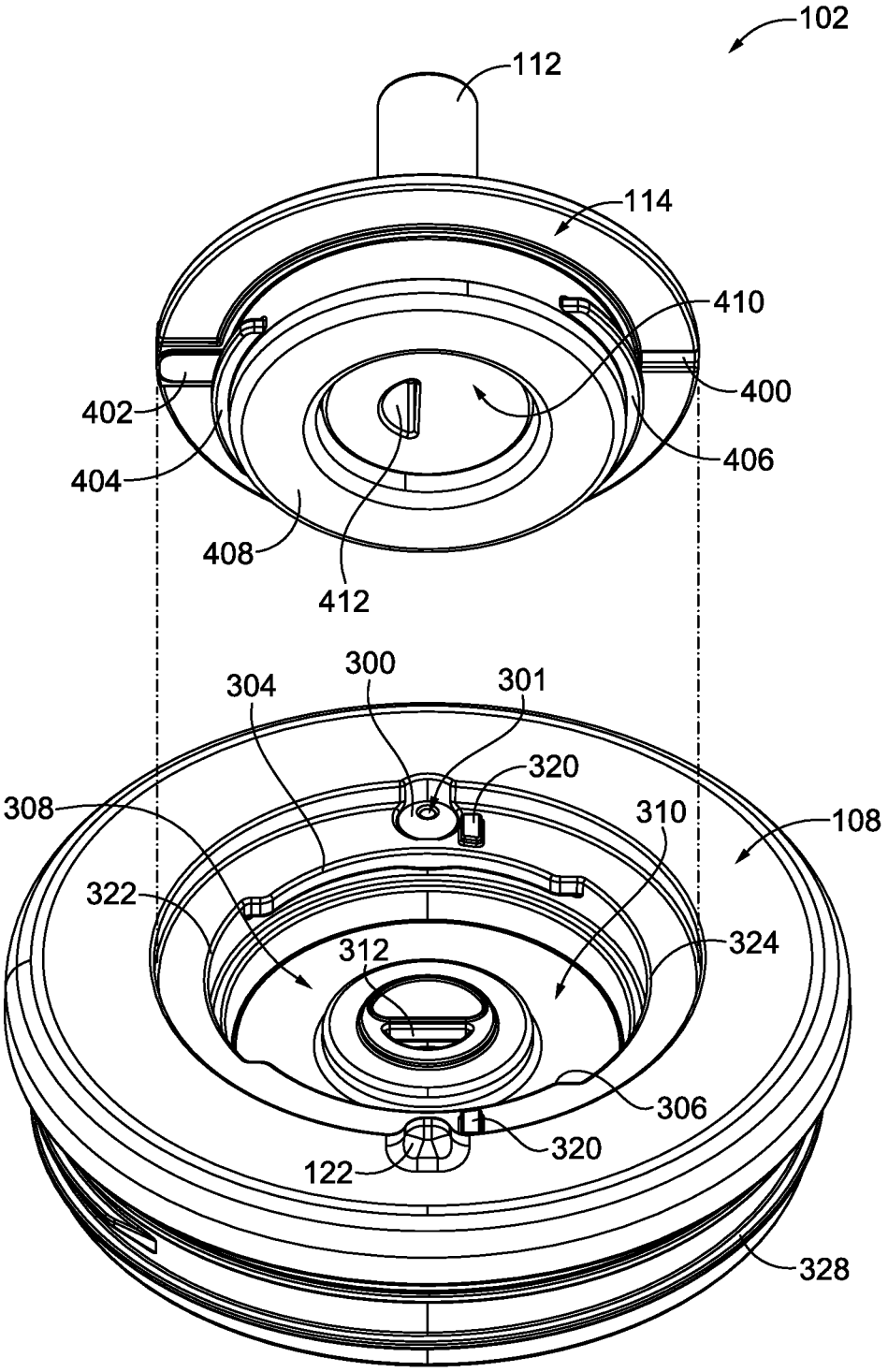
FIG. 4 depicts a close-up perspective view of the lid structure shown in FIG. 3, in accordance with aspects herein.
Figure 5A:
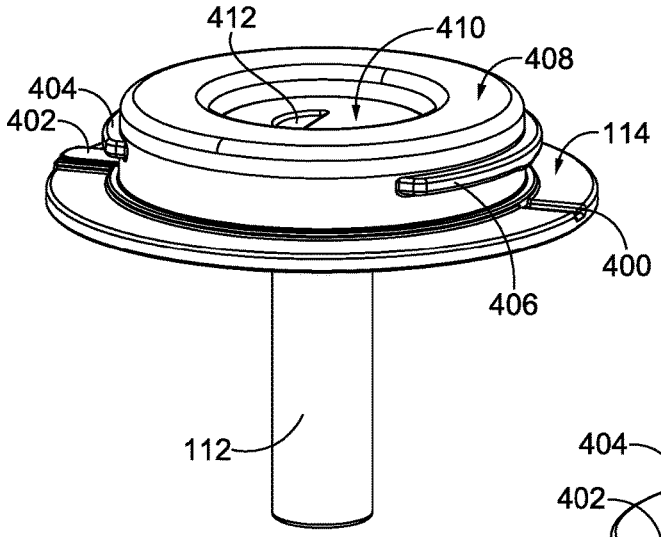
FIG. 5A depicts a perspective view of a spout portion of the straw mechanism of the beverage system, in accordance with aspects herein.
Figure 5B:
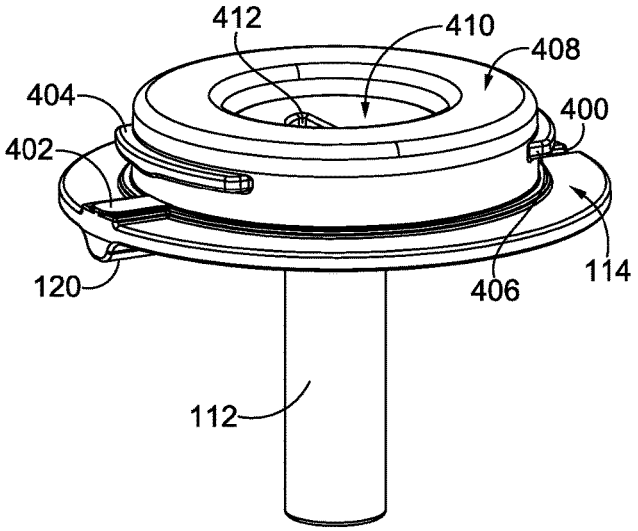
FIG. 5B depicts a different perspective view of a spout portion of the straw mechanism of the beverage system, in accordance with aspects herein.
Figure 5C:
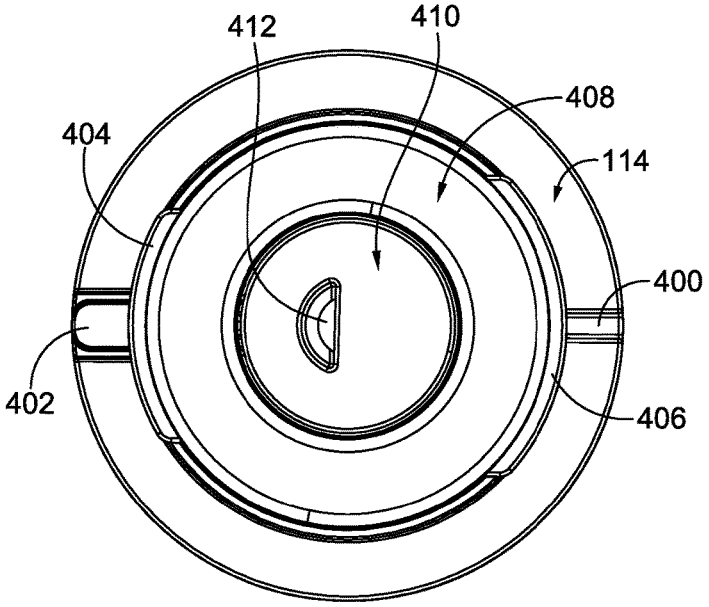
FIG. 5C depicts a different perspective view of a spout portion of the straw mechanism of the beverage system, in accordance with aspects herein.
Figure 6A:
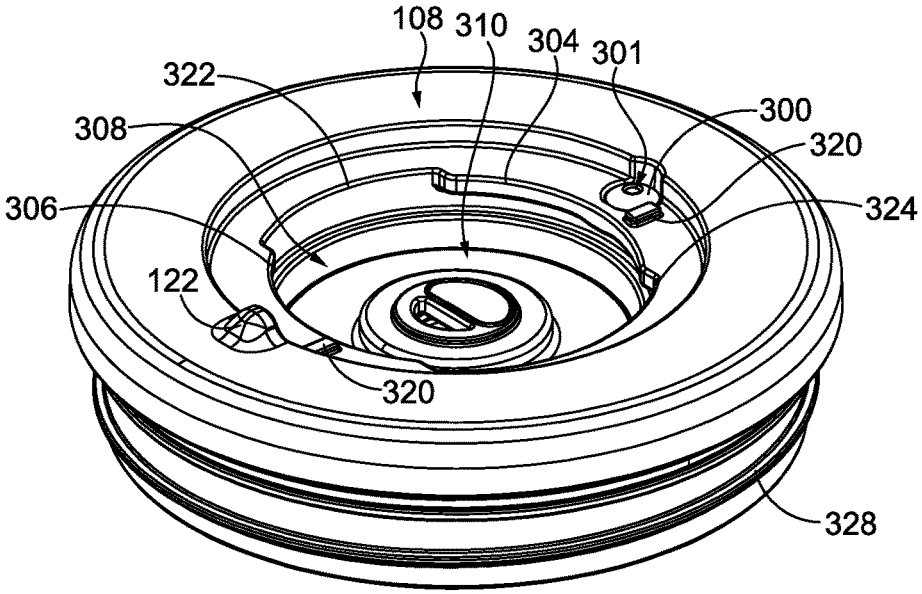
FIGS. 6A and 6B depict different perspective views of the body portion of the lid structure, in accordance with aspects herein.
Figure 6B:
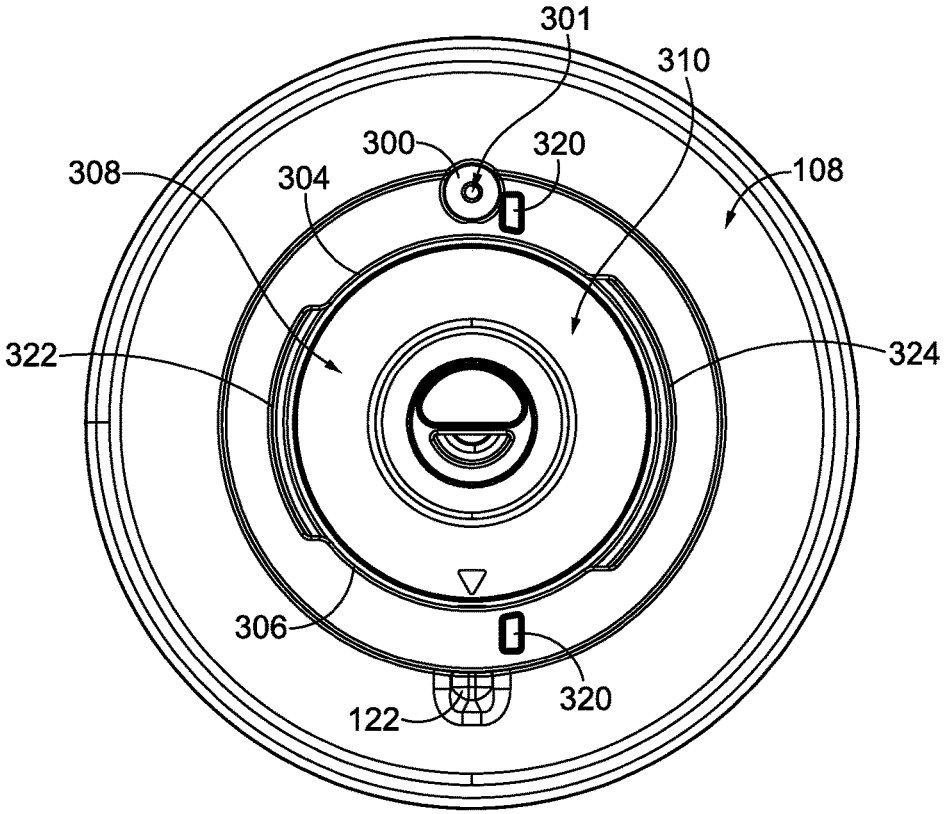

FIG. 3 depicts a partially disassembled beverage system 100. As shown, the body portion 108 and the straw mechanism 110 are able to be separated to facilitate cleaning of the components of the beverage system 100 and in particular, of the lid structure 102. As shown, the body portion 108 comprises a recess or engagement cavity 308 to accommodate components of the straw mechanism 110 so that the outer surface of the frame portion 114 and the outer surface of the body portion 108 are flush with each other when assembled, as previously shown in FIG. 1. Further, as shown, straw 302 having a straw handle 314 is shown as connected to the body portion 108. As better seen in FIGS. 4, 5A and 5B, the straw mechanism 110 has a magnetic connection where the second surface of the frame portion 114 has a first magnet housing 318 that protrudes from its inner or second surface, and houses a first magnet 802 (shown in FIG. 8). The first magnet 802 can be ring shaped extending within and around the circumference of first magnet housing 318, which may also be ring shaped. As shown in FIG. 4, the spout base portion 410 located within a cavity formed in the center of the first magnet housing 318, comprises a half-circle shaped opening 412. The second surface (i.e., interior surface) of the frame portion 114 further comprises a projection 402 aligned directly opposite to the first indicator 120 on the first surface of the frame portion. Directly opposite to the projection 402, the frame portion 114 comprises a notch 400 on the second surface of the frame portion 114. As will become more apparent in FIGS. 5A-5C and 9-12, when the straw mechanism 110 is in a dispensing state, the notch 400 aligns with the vent seal 300, and when the straw mechanism 110 is in a sealed state, the projection 402 is aligned with the vent seal 300 to seal the vent 124 by essentially plugging the opening of the vent seal 300.

The volume of the base structure 104 may be sized and shaped to hold between 14 oz. and 100 oz. of a liquid beverage. The base structure 104 may be comprised of a double wall plastic structure, glass, or polymer based material structure, or a thermally insulating structure comprised of stainless steel, aluminum, copper, or any other suitable material or combination of materials suitable for insulating the contents of the beverage container from external temperature fluctuations for extended periods of time. The base structure 104 comprises an inner wall 330 and an outer wall 332. An inner diameter of the inner wall 330 is generally smaller than an outer diameter of the outer wall 332, thereby providing a thickness to the base structure 104 between the inner wall 330 and the outer wall 332. The thickness may aid in providing insulation properties to the base structure 104 to prevent rapid cooling, rapid warming and/or sweating when containing cold or iced liquid beverages. Further, in order to improve gripping and/or gripping comfort, the base structure 104 may optionally, further comprise handle 106 which may or may not be provided with an additional frictional surface that is coated or otherwise covered with a rubber, such as for example, natural rubber, synthetic rubber, rubberized silicone, thermoplastic polyurethane, polyurethane, neoprene, nitrile, and any other suitable material having desirable properties.

As also shown in FIG. 4, the frame portion 114 further comprises a first ridge 404 and a second ridge 406 that project from the first magnet housing 318 to form the "key" portion of the straw mechanism 110, and the engagement cavity 308 forms the "lock" portion of the lid structure by having an opening defined by a first lip extension 304 and a second lip extension 306 or conversely a first lip notch 322 and a second lip notch 324. The first ridge 404 has a first length and the second ridge 406 has a second length that is different from the first length. The first lip notch 322 also has the first length and the second lip notch 324 also has the second length. As such, the straw mechanism 110 can fit into the engagement cavity 308 in only one predetermined way (i.e., the first ridge 404 passes through the first lip notch 322 and the second ridge 406 passes through the second lip notch 324), as will become more apparent from the remaining figures.

As further shown in FIGS. 3, 4, 6A and 6B, the vent seal 300 may be made from a flexible rubber or silicone material having an opening through which air is able to flow when not sealed. The first lip extension 304 and the second lip extension 306 are further equipped with stop tabs 320 respectively, that are configured to limit the rotation of the straw mechanism 110 with respect to the body portion 108 to 180° (i.e., half circle path). The body portion 108 further comprises threading 328 that secure the lid structure 102 to the base structure 104. The base structure comprises threading 326 on its interior wall 330 defining the interior volume 316 that is complementary to the threading 328. As shown, the base structure 104 has an interior volume 316 where a beverage can be contained in the base structure 104.

Figure 8:
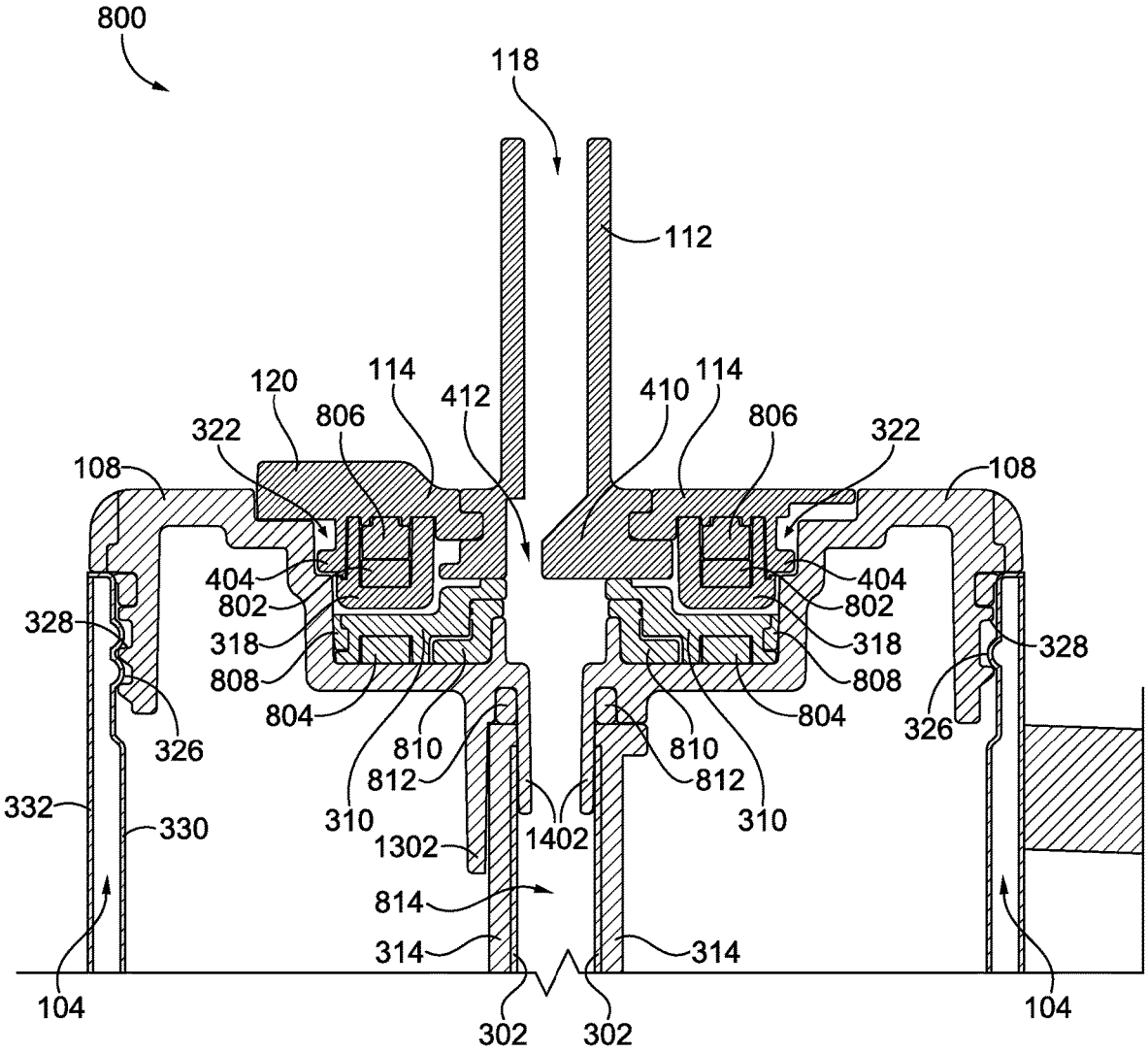
FIG. 8 depicts a cross-sectional view of the assembled beverage system along the line 8-8 in FIG. 7.
Figure 10:
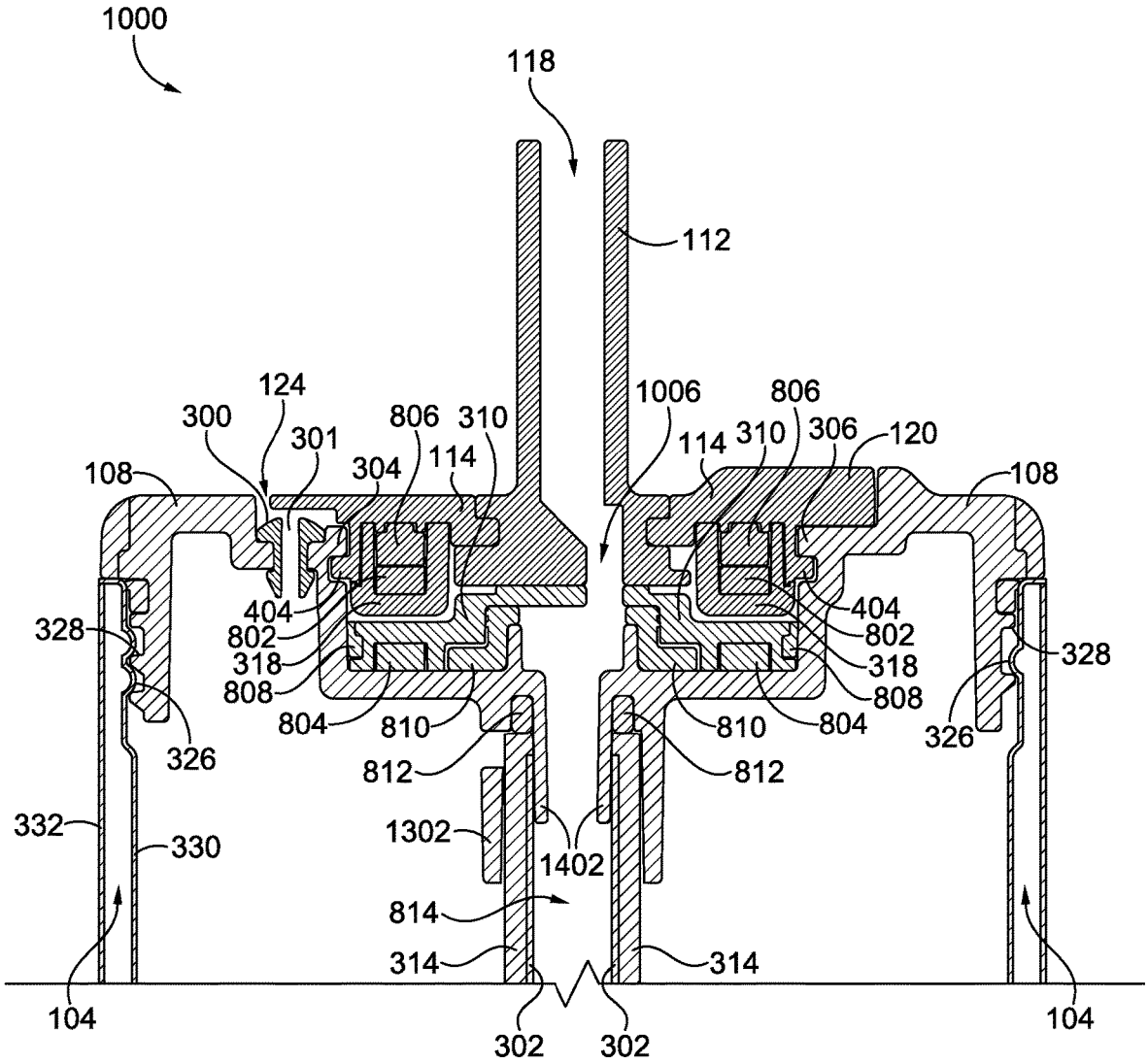
FIG. 10 depicts a cross-sectional view of the assembled beverage system along the line 10-10 in FIG. 9.
Figure 12:
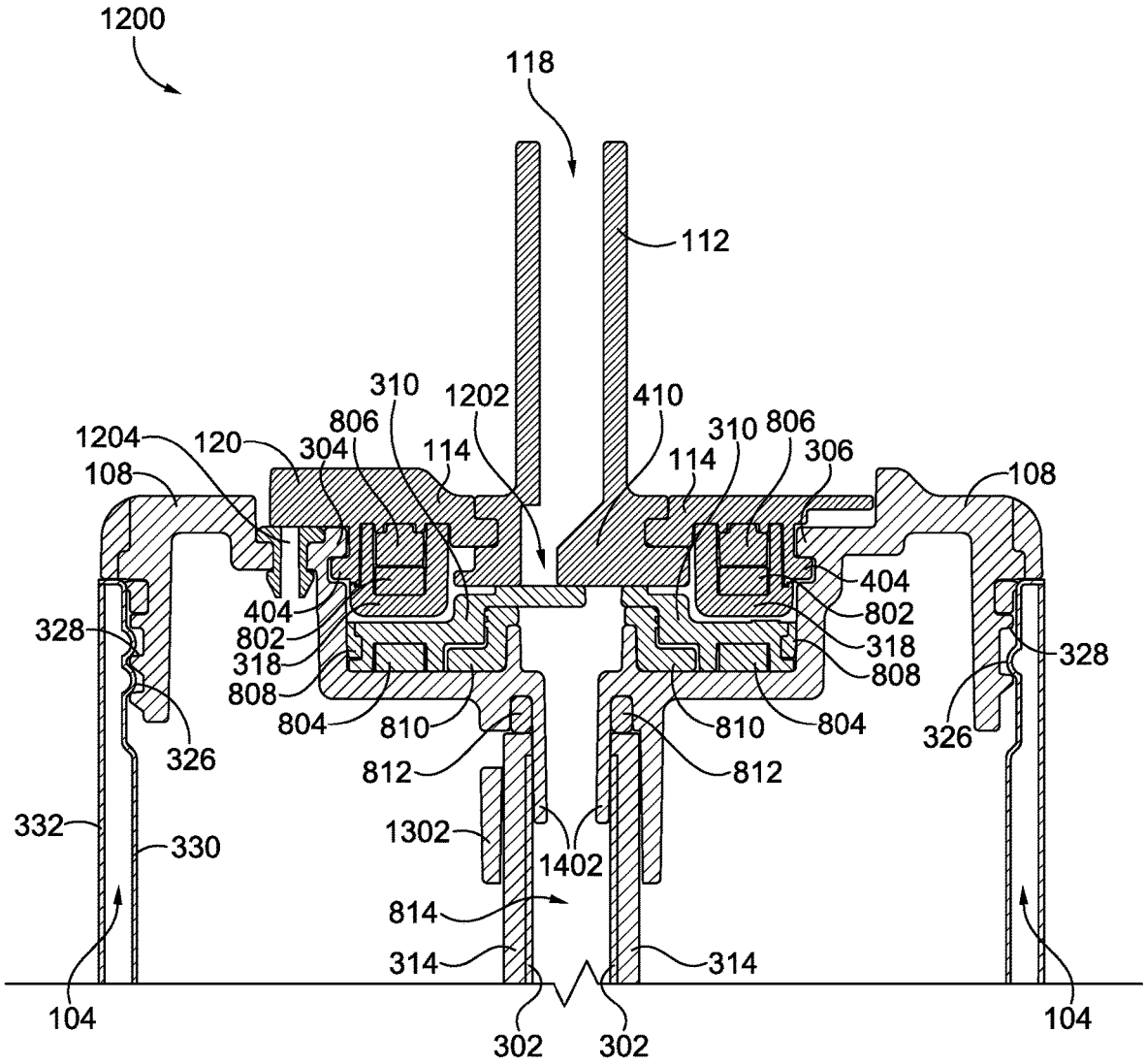
FIG. 12 depicts a cross-sectional view of the assembled beverage system along the line 12-12 in FIG. 11.

As will become more apparent in FIGS. 8, 10, and 12, the body portion 108 houses a second magnet 804 within the engagement cavity 308 that is secured and covered by a cover portion 310. The cover portion 310 comprises a second half-circle shaped opening 312 that works with the half-circle shaped opening 412 of the spout base portion 410 to form the straw mechanism 110. The straw mechanism 100 is able to transition from a dispensing state and a closed state (sealed state). The straw mechanism 100 is in the dispensing state when the half-circle shaped opening 312 and the half-circle shaped opening 412 are aligned with each other. The closed state, on the other hand, is when the half-circle shaped opening 412 and the half-circle shaped opening 312 are not aligned with each other (are directly opposite to each other).

Figure 7:
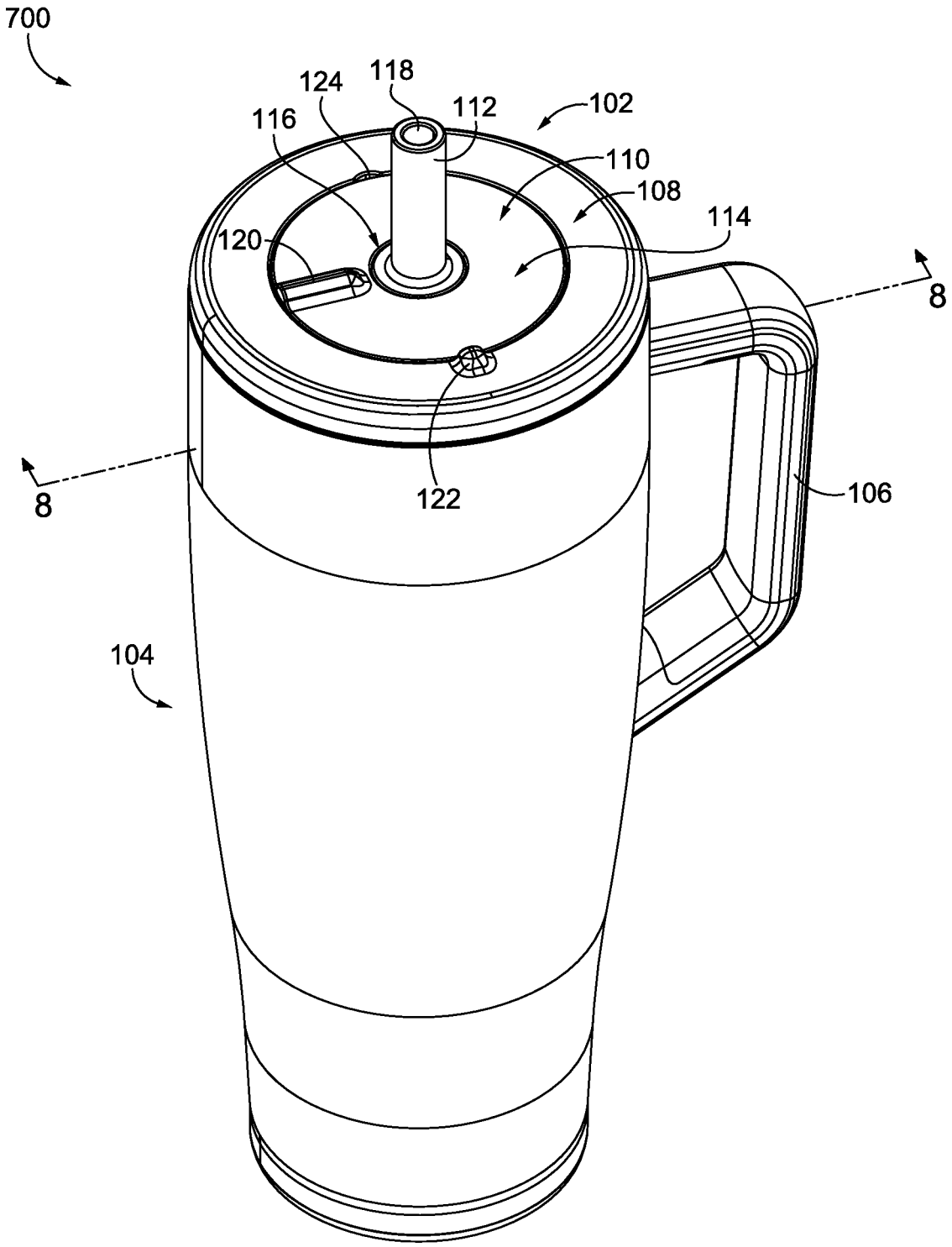
FIG. 7 depicts a perspective view of an assembled beverage system with a lid structure in an unlocked state, in accordance with aspects herein.

FIG. 7 shows the beverage system 100 in an unlocked state 700. When in the unlocked state 700, the first indicator 120 is located a quarter turn of the straw mechanism 110 between the second indicator 122 and the vent 124, or in other words, at a 90° clockwise rotation point from the second indicator 122. As better shown in FIG. 8, the first ridge 404 is aligned with the first lip notch 322 and the second ridge 406 is aligned with the second lip notch 324 such that the straw mechanism 110 can be pulled out or separated from the body portion 108 of the lid structure 102, as shown previously in FIGS. 3 and 4. The removal of the straw mechanism 110 from the body portion 108 facilitates access to areas of the lid structure 102 underlying the straw mechanism 110, for cleaning, by way of example. As described above and further shown in the cross-sectional view 800 shown in FIG. 8, the first magnet housing 318 houses a first magnet 802, which when the straw mechanism 110 is within the engagement cavity 308, the first magnet 802 is aligned with a second magnet 804 housed within the engagement cavity 308 and secured in place by the cover portion 310. The first magnet 802 and the second magnet 804 have opposing polarities so that they strongly attract each other and are held magnetically even in this unlocked state 700 so that the user has better control of the parts and the parts will not just come loose on their own. The user has to make a pulling motion on the straw mechanism 110 to pull it apart from the body portion 108.

As shown, in FIG. 8, the first magnet 802 is secured within the first magnet housing 318 by elastic gasket 806. Further, the cover portion 310 is sealed by elastic seal 808 and elastic seal 810, thereby effectively securing the second magnet 804 within the body portion 108. As shown, when the straw mechanism 110 is within the engagement cavity 308, the first magnet 802 and the second magnet 804 are in alignment with each other. It is contemplated in accordance with aspects herein that the first magnet 802 and the second magnet 804 are each one piece ring shaped magnets. In accordance with other aspects, rather than being ring shaped, the first magnet 802 and the second magnet 804 may be open ring or in other words, arch shaped. The first arch shaped magnet may occupy at least 50% of the first magnet housing 318 and the second magnet 804 may also be arch shaped to match the shape of the first magnet 802. Alternatively, the arch shaped magnets may be smaller, each occupying, for example, less than 50% of the first magnet housing 318. In such embodiments, there may be two or more arch shaped magnets distributed at different locations within the first magnet housing 318, each occupying at least 10% of the first magnet housing 318. The arch shaped magnets within the engagement cavity 308 may then be made to match up the arch shaped magnets within the first magnet housing 318. As further shown, when the straw 302 is connected to the body portion 108, a straw fitting 1402 of the body portion 108 is configured to fit within the straw opening 814, which is located within straw connection port 1302. The straw connection portion 1302 defines a socket 1306, as will become more apparent in FIG. 13. The straw 302 and the body portion 108 are sealed by elastic gasket 812 when connected to each other.

Figure 9:
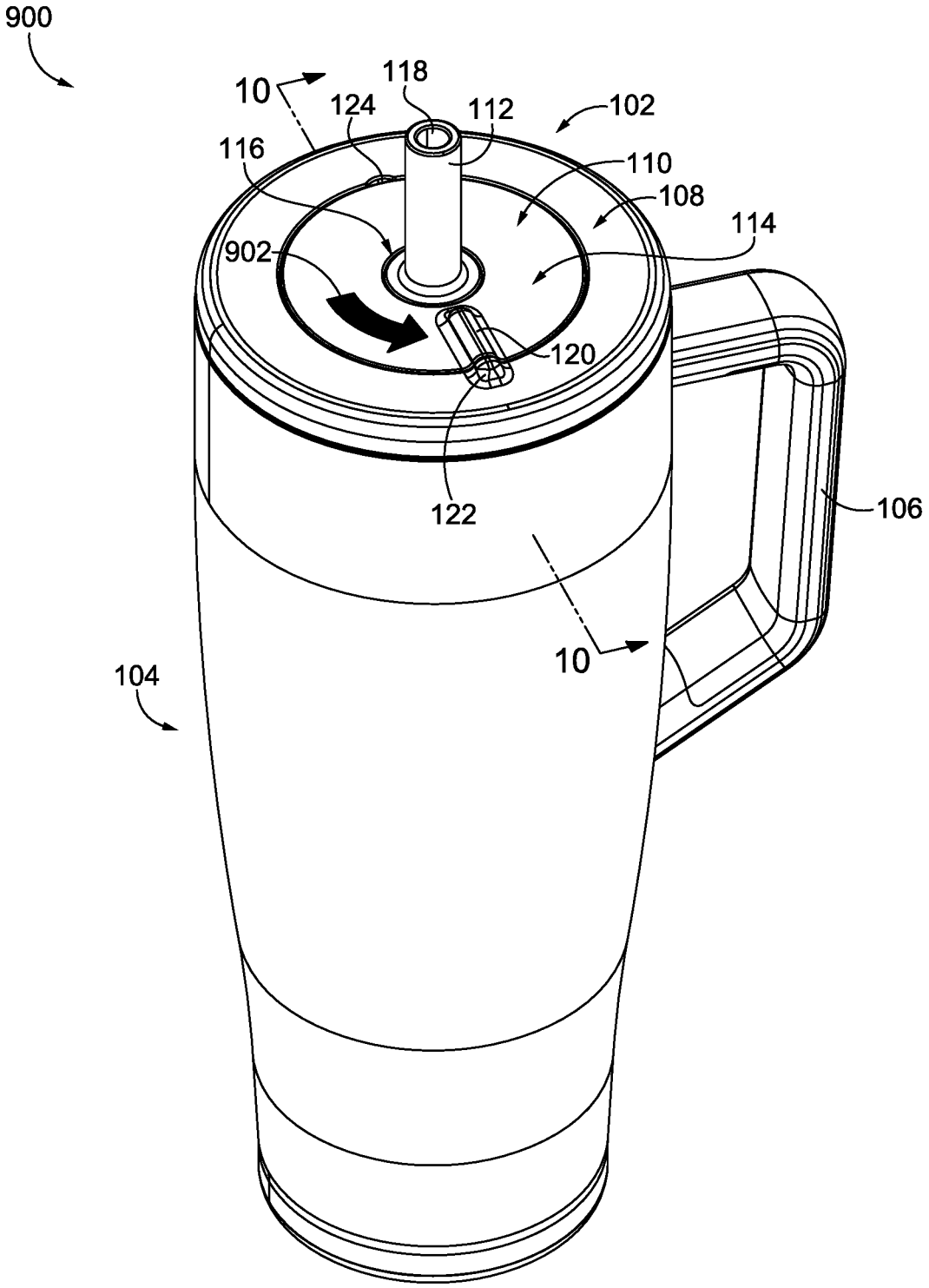
FIG. 9 depicts a perspective view of an assembled beverage system with a lid structure in a dispensing state, in accordance with aspects herein.

FIG. 9 shows the beverage system 100 in a locked and dispensing state 900. When in the locked and dispensing state 900, the first indicator 120 is rotated counter-clockwise from the disassemblable state 700 as shown by arrow 902, to align the first indicator 120 and the second indicator 122. In other words, the straw mechanism 110 is rotated a quarter turn counter-clockwise from the unlocked state so that the first indicator 120 is positioned at a 0° rotation point from the second indicator 122. As better shown in cross-sectional view 1000 in FIG. 10, the first ridge 404 is aligned with the second lip extension 306 and the second ridge 406 is aligned with the first lip extension 304 such that the straw mechanism 110 is locked within the engagement cavity 308 and thus, cannot be separated from the body portion 108 of the lid structure 102. In the locked and dispensing state 900, a connected opening 1006 is formed where the spout opening 118, the half-circle shaped opening 412, the half-circle shaped opening 312, and the straw opening 814 are all aligned with each other, thereby, allowing free flow of the contents within the interior volume 316 through the connected opening 1006. As the contents are being emptied, air can be pulled in from the vent 124, which has a vent seal 300 with a vent opening 301. This prevents a vacuum from being formed within the interior volume 316, which would make the contents harder and harder to pull through the spout portion 112. As shown, the notch 400 of the frame portion 114 is aligned with the vent seal 300 so as to not impede air flow through the vent opening 301.

Figure 11:
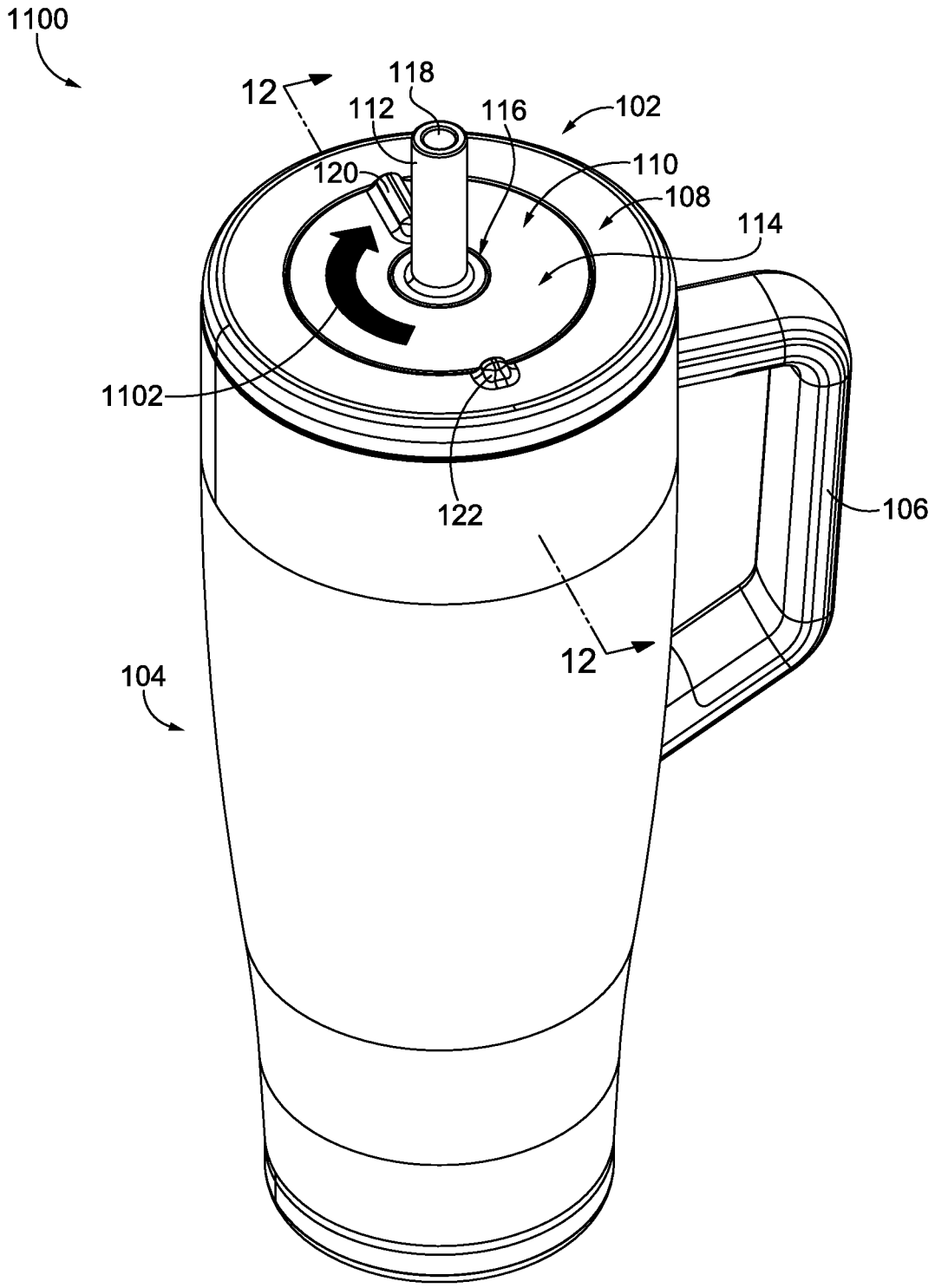
FIG. 11 depicts a perspective view of an assembled beverage system with a lid structure in a closed state, in accordance with aspects herein.

FIG. 11 shows the beverage system 100 in a locked and non-dispensing state 1100. When in the locked and non-dispensing state 1100, the first indicator 120 is rotated clockwise from the disassemblable state 700 as shown by arrow 1102, to place the first indicator 120 and the second indicator 122 on opposite sides from one another, or in other words, at a 180° rotation point from the second indicator 122. As better shown in cross-sectional view 1200 of FIG. 12, the first ridge 404 is aligned with the first lip extension 304 and the second ridge 406 is aligned with the second lip extension 306 such that the straw mechanism 110 is also locked within the engagement cavity 308 and thus, cannot be separated from the body portion 108 of the lid structure 102. In the locked and non-dispensing state 1100, a disconnected opening 1202 is formed where the half-circle shaped opening 412 and half-circle shaped opening 312 are misaligned with each other (i.e., on opposite sides of each other), thereby blocking flow from the straw opening 814 into the spout opening 118. Additionally, the projection 402 on the underside of the frame portion 114 is aligned with the vent seal 300, thereby blocking the vent opening 301 of the vent seal 300, resulting in a blocked opening 1204, thereby, effectively creating a leak-proof configuration.

Figure 13:
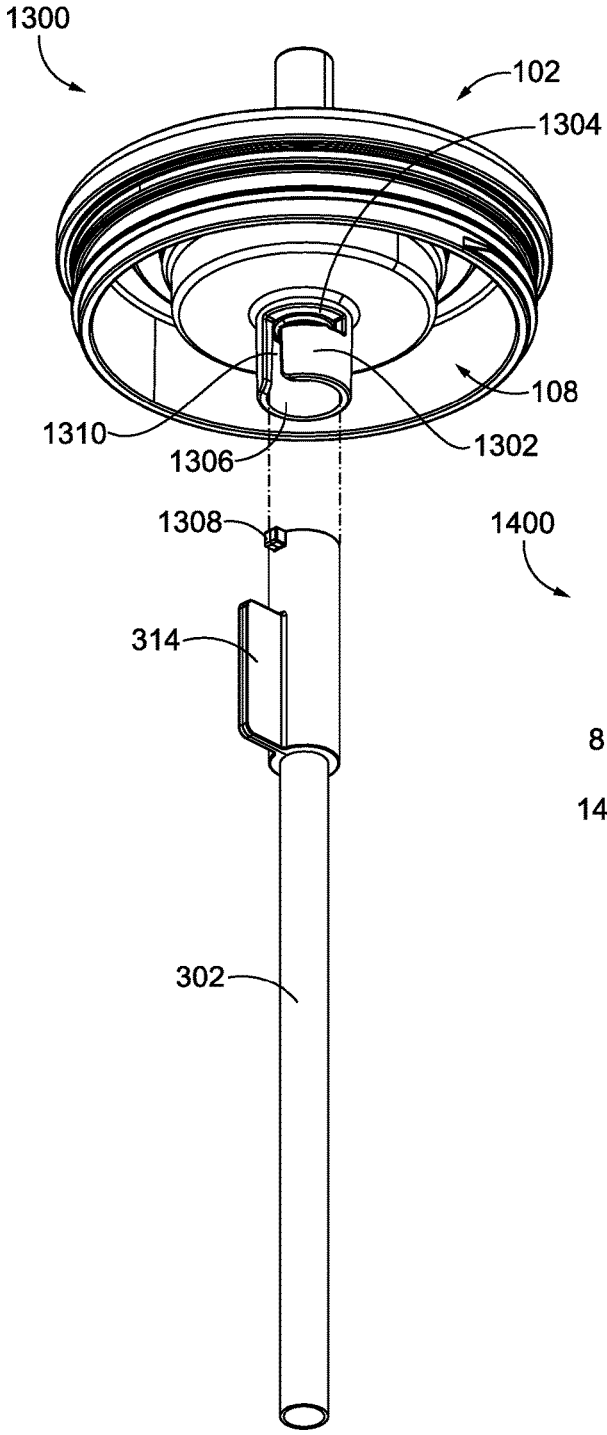
FIGS. 13 and 14 depict different perspective views of a disassembled straw system, in accordance with aspects herein.
Figure 14:
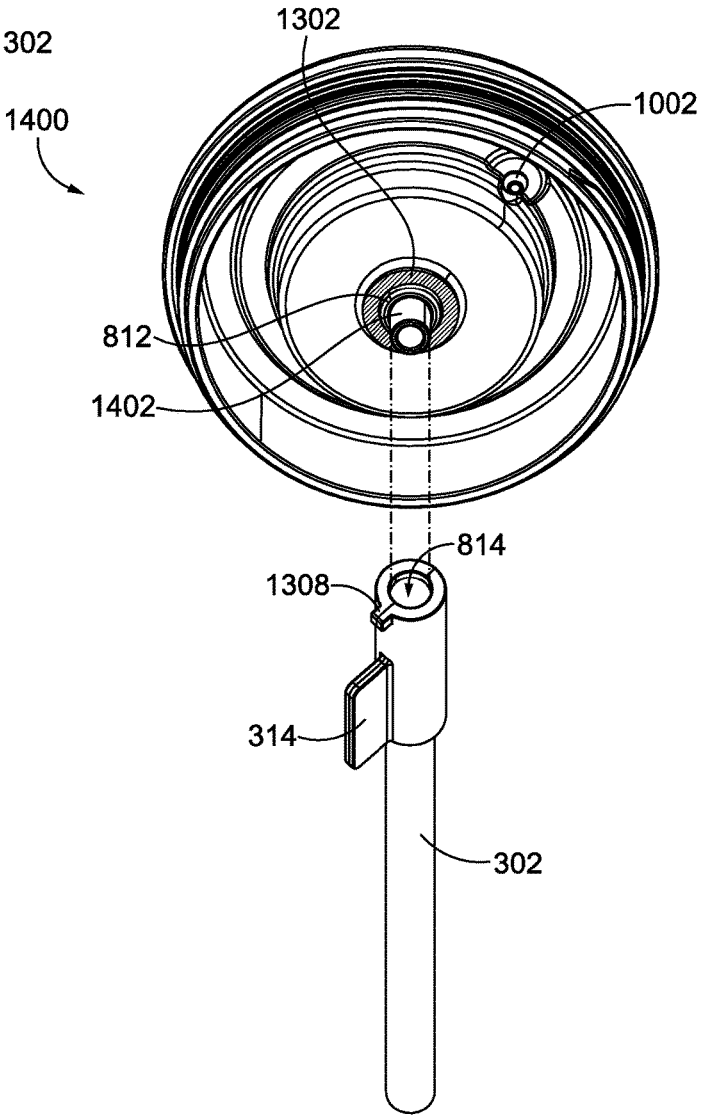

FIG. 13 shows the straw assembly view 1300. As shown, the straw 302 has a straw handle 314 with a straw tab 1308. The straw 302 may be made from any suitable material that is safe for use such as stainless steel, glass, silicone, bisphenol A (BPA) free plastics, and the like. The handle 314 may be molded onto the straw 302, or may be made as one piece with the straw 302, or maybe fitted onto straw 302. The handle 314 may be made from the same material as the straw 302, or a different material as the straw 302. The handle 314 may be removable from straw 302 or permanently affixed to straw 302. As shown, the body portion 108 of lid structure 102 has a straw connection port 1302 on the underside of the lid structure 102. The straw connection port 1302 can be located opposite the engagement cavity 308, and defines a socket 1306. The straw connection port 1302 has a vertical guide 1310 (parallel to a direction of the straw length) that transitions into a horizontal guide 1304 that is perpendicular or orthogonal to the vertical guide 1310. Further, as shown in FIG. 14 with the body of the connection port 1302 removed, a straw fitting 1402 within the socket 1306 is configured to fit within the straw opening 814. At the base of the straw fitting 1402 is an elastic gasket 812 to seal the fitting of the straw 302 and the body portion 108.

Figure 15:
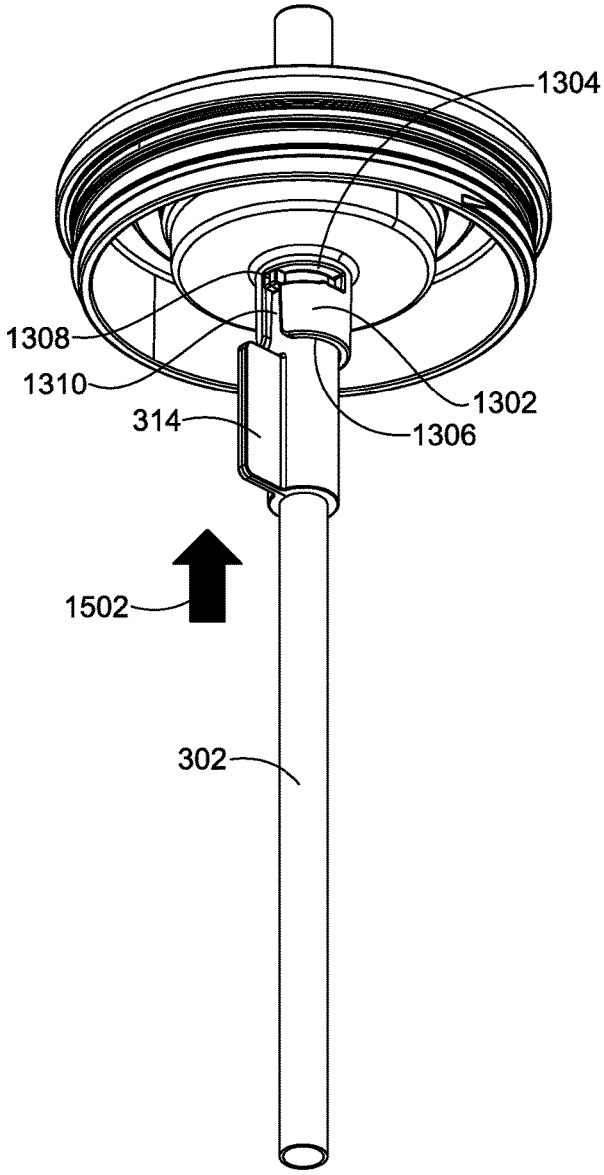
FIGS. 15 and 16 depict different perspective views of an assembled straw system, in accordance with aspects herein.
Figure 16:
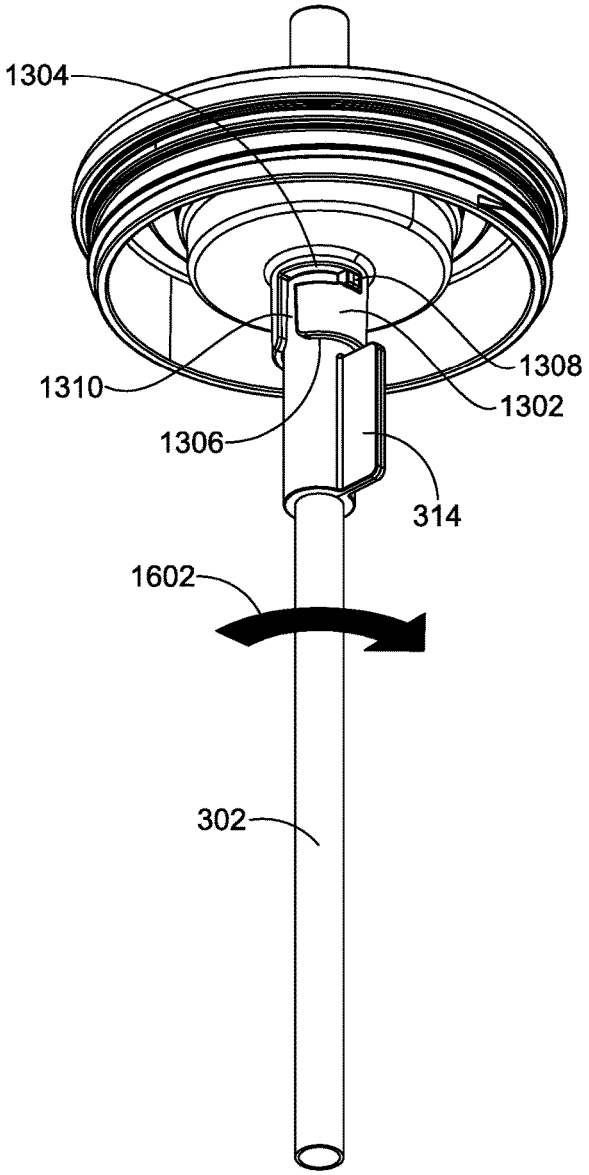

As shown in FIGS. 15-16, the steps for assembling the straw 302 to the lid structure 102 are depicted. Looking at FIG. 15, the tab 1308 is glided upwards in a vertical direction 1502 through the vertical guide 1310 of the straw connection portion 1302. To facilitate the process, the straw handle 314 may be directly aligned with the tab 1308. Once the straw is within the socket 1306, FIG. 16 illustrates that the straw 302 can be turned in a clockwise direction 1602, guiding the tab 1308 through the horizontal guide 1304, thereby locking the straw to the body portion 108. Again, this motion can be facilitated by placing a clockwise directional force on the straw handle 314.

Additionally, although some exemplary implementations of the embodiments described herein are shown in the accompanying figures, these implementations are not intended to be limiting. Rather, it should be understood that the various embodiments and aspects described herein may be implemented upon any insulated container.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed:

1. A lid structure for a beverage container, comprising:

a body portion having a top side that defines an engagement cavity, the engagement cavity presenting a fluid interface in fluid communication with an interior volume of the beverage container; and a straw mechanism configured to be removably inserted into the engagement cavity, the straw mechanism having a frame portion sized and shaped to fit within the engagement cavity, and a spout portion having a distal end surface that presents an opening positioned to align with the fluid interface, wherein the straw mechanism is rotatable within the engagement cavity between a locked state in which the straw mechanism is rotatably secured within the engagement cavity, and an unlocked state in which the straw mechanism can be removed from the engagement cavity.

2. The lid structure of claim 1, wherein the frame portion includes at least a first magnet, and the body portion includes at least a second magnet.

3. The lid structure of claim 2, wherein at least the first magnet and at least the second magnet are adapted to produce a magnetic bias that retains the straw mechanism within the engagement cavity when the straw mechanism is in the unlocked state.

4. The lid structure of claim 2, wherein at least the first magnet is housed within the frame portion, and at least the second magnet is housed within the body portion.

5. The lid structure of claim 1, wherein an upper surface of the frame portion presents at least one protrusion configured to facilitate rotation of the straw mechanism between the locked state and the unlocked state.

6. The lid structure of claim 1, the frame portion being sized and shaped to pass through a set of lip extensions and/or a set of lip notches formed on or within the engagement cavity so that the straw mechanism can be inserted into the engagement cavity.

7. The lid structure of claim 1, wherein the spout portion is adapted to align with the fluid interface so that fluid may pass from the interior volume to the spout portion.

8. The lid structure of claim 1, the body portion further having a vent to facilitate air flow into the interior volume.

9. The lid structure of claim 1, further comprising a detachable straw removably coupled to an underside of the body portion, the detachable straw extending into the interior volume of the beverage container.

10. The lid structure of claim 1, the body portion further having threads that are complementary to a threaded region of a base structure of the beverage container to removably secure the lid structure onto the base structure.

11. A beverage container comprising:

a base structure; and a lid structure including a body portion that is removably secured to the base structure, the body portion having a top side that defines an engagement cavity, the engagement cavity presenting a fluid interface that is in fluid communication with an interior volume of the beverage container, and a straw mechanism configured to be removably inserted into the engagement cavity, the straw mechanism having a frame portion sized and shaped to fit within the engagement cavity, and a spout portion having a distal end surface that presents an opening positioned to align with the fluid interface, wherein the straw mechanism is rotatable within the engagement cavity between a locked state in which the straw mechanism is rotatably secured within the engagement cavity, and an unlocked state in which the straw mechanism can be removed from the engagement cavity.

12. The beverage system of claim 11, wherein the frame portion includes at least a first magnet, and the body portion includes at least a second magnet.

13. The beverage system of claim 12, wherein at least the first magnet and at least the second magnet are adapted to produce a magnetic bias that retains the straw mechanism within the engagement cavity when the straw mechanism is in the unlocked state.

14. The beverage system of claim 12, wherein at least the first magnet is housed within the frame portion, and at least the second magnet is housed within the body portion.

15. The beverage system of claim 11, wherein an upper surface of the frame portion presents at least one protrusion configured to facilitate rotation of the straw mechanism between the locked state and the unlocked state.

16. The beverage system of claim 11, the frame portion being sized and shaped to pass through a set of lip extensions and/or a set of lip notches formed on or within the engagement cavity so that the straw mechanism can be inserted into the engagement cavity.

17. The beverage system of claim 11, wherein the spout portion is adapted to align with the fluid interface so that fluid may pass from the interior volume to the spout portion.

18. The beverage system of claim 11, the body portion further having a vent to facilitate air flow into the interior volume.

19. The beverage system of claim 11, further comprising a detachable straw removably coupled to an underside of the body portion, the detachable straw extending into the interior volume of the beverage container.

20. The beverage system of claim 11, the body portion further having threads that are complementary to a threaded region of the base structure to removably secure the lid structure onto the base structure.

* * * * *